US005579552A

United States Patent [19]

Henry

[11] Patent Number: 5,579,552

[45] Date of Patent: Dec. 3, 1996

[54] TODDLER RESTRAINT APPARATUS

[76] Inventor: Jesse E. Henry, P.O. Box 671821, Houston, Tex. 77267-1821

[21] Appl. No.: 387,286

[22] Filed: Feb. 10, 1995

[51] Int. Cl.[6] ..... A47D 15/00

[52] U.S. Cl. ..... 5/655; 5/424; 5/922; 5/417; 128/819; 128/846

[58] Field of Search ..... 128/869, 876, 128/882, 846; 5/417, 420, 424, 655, 922

[56] References Cited

U.S. PATENT DOCUMENTS

| | | | |
|---|---|---|---|
| 1,639,424 | 8/1927 | Breslin . | |
| 1,651,561 | 12/1927 | Storey . | |
| 2,434,968 | 1/1948 | Smith | 227/49 |
| 2,727,242 | 12/1955 | Pascal | 5/420 X |
| 2,758,595 | 8/1956 | Lovett | 128/134 |
| 4,671,393 | 6/1987 | Rainey | 190/7 |
| 4,747,779 | 5/1988 | Gerstung | 128/882 X |
| 4,780,706 | 10/1988 | Bollag | 340/666 |
| 4,862,535 | 9/1989 | Roberts | 5/922 X |
| 5,035,013 | 7/1991 | Bloom | 5/420 |
| 5,050,620 | 9/1991 | Cooper | 128/882 X |
| 5,329,934 | 7/1994 | Bowman | 128/845 |
| 5,331,699 | 7/1994 | Patton et al. | 128/876 X |
| 5,333,623 | 8/1994 | Fuller | 128/875 |
| 5,416,938 | 5/1995 | Li | 5/922 X |
| 5,448,790 | 9/1995 | Saro et al. | 5/922 X |
| 5,472,411 | 12/1995 | Montay et al. | 128/882 X |
| 5,472,414 | 12/1995 | Detty | 128/882 X |

*Primary Examiner*—Michael F. Trettel
*Attorney, Agent, or Firm*—Harrison & Egbert

[57] ABSTRACT

An apparatus for restraining the movement of a toddler including a securing member for affixing to the toddler and having a surface of hook-and-loop material thereon, and a perimeter member having a complementary hook-and-loop material surface formed thereon. The complementary hook-and-loop material surface is engagable with the surface of the securing member so as to prevent movement of the toddler thereacross. The perimeter member can either have a top surface entirely covered with the complementary hook-and-loop material or an outer edge formed of such material with an interior devoid of such material. The securing member can be in the form of a sandal having a sole of hook material facing outwardly therefrom or it can be in the form of a kneepad having an outer surface of hook material facing outwardly therefrom. Specifically, the securing member, in either the form of the kneepad or the sandal, includes an I-shaped member having a surface of hook-and-loop material on one side and a plurality of straps extending outwardly from the I-shaped member.

19 Claims, 3 Drawing Sheets

TODDLER RESTRAINT APPARATUS

TECHNICAL FIELD

The present invention relates to apparatus for restraining toddlers. More particularly, the present invention relates to apparatus that allow freedom of movement of the toddler within a restraining area.

BACKGROUND ART

In virtually all home environments, it is common to restrain a toddler in one form or another. A toddler would suffer from loneliness if placed in a separate room alone and away from other human beings. Countless toddlers suffer the fate of such strict confinement. Traditionally, the only way to keep toddlers within the comfort zone of the parents is to place them into a tiny pen, strap them into a highchair, or to install unsightly fencing. Psychologically, such confinement can be damaging to the toddler as the toddler matures.

In the past, various devices have been developed which can sound an alarm when the child goes beyond a given area or physically restrain the movement of the toddler. However, heretofore, there have been few advances in the field which allow the toddler unrestrained movement within a given territory.

In the past, U.S. Pat. No. 1,639,424, issued on Aug. 16, 1927, to M. Breslin, U.S. Pat. No. 1,651,561, issued on Dec. 6, 1927, to R. E. Storey, U.S. Pat. No. 2,434,968, issuing on Jan. 27, 1948, to B. I. Smith, and U.S. Pat. No. 2,758,595, issued on Aug. 14, 1956, to C. R. Lovett describe various harnesses for use with children. Each of these harness devices is designed so as to be attached to the body of the toddler and to restrain the movement of the toddler beyond a given area. In some cases, these harnesses are particularly designed to restrict the movement of the toddler to the particular location in which the toddler is placed. In other circumstances, the harnesses are designed so as to allow the toddler to only move for a given distance before the toddler is "jerked" to a stopping position. All of these approaches of harnessing the child are uncomfortable for the child and unduly restrict the motion and movement of the toddler.

U.S. Pat. No. 4,780,706, issued on Oct. 25, 1988, to N. Bollag describes a toddler training device which includes a pressure mat that is sensitive to the weight of the toddler. A sounder unit provides a loud, high-frequency sound whenever the toddler moves beyond a predetermined perimeter. The alarm is intended to emit a loud, high frequency tone that is disturbing and startling to the toddler. Such a sound would also serve to alert parents of the movement of the toddler beyond the given perimeter. This device does not prevent the toddler from moving over the alarm area and can be quite traumatic to the toddler.

It is an object of the present invention to provide an apparatus that effectively confines the area of movement of the toddler.

It is another object of the present invention to provide an apparatus that controls the area of movement of the toddler.

It is another object of the present invention to provide a toddler restraint apparatus that is slim, lightweight, foldable, and durable.

It is still another object of the present invention to provide a restraint apparatus that assures the safety of the toddler.

It is still another object of the present invention to provide a toddler restraint apparatus that can be adapted to feet and/or knees of the toddler.

These and other objects and advantages of the present invention will become apparent from a reading of the attached specification and appended claims.

SUMMARY OF THE INVENTION

The present invention is an apparatus for restraining the movement of a toddler that comprises a securing means having a surface of hook-and-loop material thereon for affixing to the body of the toddler, and a perimeter member having a complementary hook-and-loop material surface formed thereon. The complementary hook-and-loop material surface is engagable with the surface of the securing means so as to prevent movement of the toddler thereacross.

In one embodiment of the present invention, the perimeter member has a top surface that is entirely covered with the hook-and-loop material. In an alternative embodiment, the perimeter member has an outer edge of the complementary hook-and-loop material and an interior which is devoid of such material. The perimeter member has a bottom surface that is made of a material other than hook-and-loop material and a cushion material interposed between the top surface and the bottom surface. The complementary hook-and-loop material, as used on the perimeter member, is of loop material.

The securing means can either be a sandal that has a sole of hook material facing outwardly therefrom or a kneepad that has an outer surface of hook material facing outwardly therefrom. Specifically, the securing means includes an I-shaped member having a surface of hook material on one side, and a plurality of straps extending outwardly from the I-shaped member. The plurality of straps serve to secure the I-shaped member to the desired location on the body of the toddler.

DETAILED DESCRIPTION OF THE INVENTION

Figure 1:
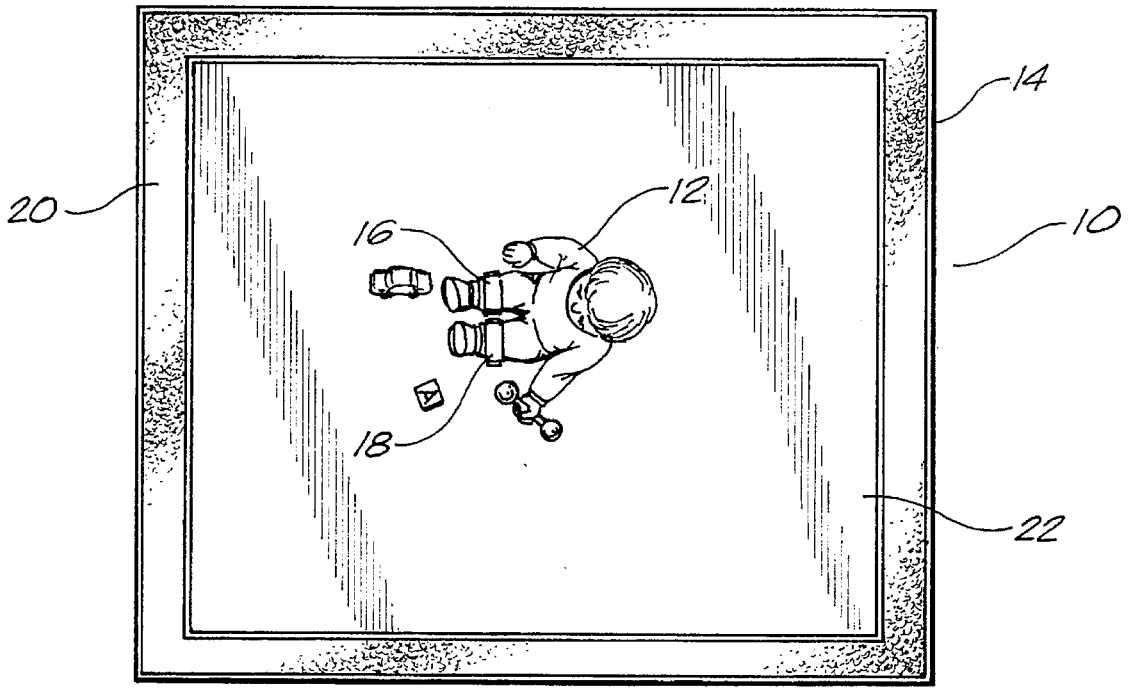
FIG. 1 is a plan view showing the apparatus of the present invention.

Referring to FIG. 1, there is shown at 10 the apparatus in accordance with the present invention for the restraint of a toddler 12. It can be seen in FIG. 1 that the apparatus 10 includes a perimeter member 14 and securing members 16 and 18 affixed around the knees of the toddler 12. The perimeter member 14 includes an outer edge 20 of hook-and-loop material which is complementary to hook-and-loop material formed on the securing members 16 and 18. The central area 22 is devoid of such hook-and-loop material so as to allow the toddler 12 freedom of movement within the area defined by the complementary hook-and-loop material at the outer edge 20.

In FIG. 1, it can be seen that the toddler 12 has the securing members 16 and 18 affixed around the knees of the toddler. The securing members should be applied so that they are comfortable for the toddler. In normal use, the securing members will remain in their proper positions upon the knees of the toddler 12. As will be described in another embodiment of the present invention, the securing members 16 and 18 can be applied to the feet of the toddler 12, if the toddler is of a walking age. The securing members 16 and 18 are applied to the knees of a toddler that is not yet of walking age.

Under normal use, the toddler 12 can play with his or her toys within the area 22. Area 22 can be made of a vinyl material which is secured, along its edges, to the complementary hook-and-loop material 20. Alternatively, the area 22 can simply be an open area which is exposed to the floor or to any rug placed upon the floor. In such a configuration, the area 22 would simply be open and the outer edge 20 would form the perimeter for the defined area of play for the toddler 12.

As will be described hereinafter, when the toddler 12 moves onto the outer edge 20, the outer surface of the securing members 16 and 18 will contact the surface 22. However, when contact is established between the hook-and-loop material of the securing members 16 and 18 and the complementary hook-and-loop material of the outer edge 20, the movement of the toddler 12 will be restrained. Since both of the knees of the toddler 12 will be engaged by the complementary hook-and-loop material of the outer edge 20, the toddler will no longer be able to move his or her knees in a crawling manner. As such, the toddler is effectively prevented from moving beyond the confines of the perimeter member 14. The toddler will be restrained until a supervising adult is available so as to separate the hook-and-loop material of the securing members 16 and 18 from the complementary hook-and-loop material of the outer edge 20. The toddler will eventually learn that movement into the area of the outer edge 20 will be restricted. An important and novel aspect of the present invention is the fact that the engagement of the knees of the toddler 12 with the outer edge 20 will prevent further relative movement between the knees of the toddler and, thusly, prevent further crawling. The toddler will be unable to continue to drag the perimeter member 14 with his or her movement.

The apparatus 10 of the present invention utilizes this VELCRO (TM) material so as to create a fenceless boundary along the toddler 12. The apparatus 10 provides the toddler with the freedom to play, feed, and sleep anywhere that is chosen by the parents. However, the apparatus 10 allows the parents to control the dimensions for the playing, feeding, or sleeping area and to determine which areas are to be restrained. If the toddler 12 attempts to leave and turns over into a crawling position or starts to walk, then the tiny hooks in the VELCRO (TM) material on the securing members 16 and 18 will attach to the loops in the perimeter member 14. This will effectively prevent further advancement. This system of restraint does not harm the toddler in any way. The only thing that is necessary to deactivate the system is for the parent or guardian to gently peel the securing members 16 and 18 away from the perimeter member 14. The apparatus 10 provides the parents with an option of two types of mats. A larger mat can be provided with a loop-free area and a smaller mat can be provided without a loop-free area.

The apparatus 10 is slim, lightweight, foldable, and is of a durable design. This apparatus 10 can fit subtly in any room of the house or lay neatly on any bed if desired. This system of safety and control does not require assembly or nuts and bolts. It is easy to fold up and to carry. The configuration of the apparatus 10 of the present invention is unlikely to be damaged by constant use.

The apparatus 10 works with virtually all toddlers, as long as they are crawlers or beginning walkers. This apparatus 10 works by using the principle of inertia in relationship with the VELCRO (TM). As long as the toddler does not try to leave the predetermined boundary, the system will not activate. The perimeter member 14 can be padded with a soft cushion so as to absorb any falls and to provide a comfortable surface for the toddler.

In order to activate the apparatus 10 of the present invention, it is only necessary to strap the securing members 16 and 18 to the knees and/or feet of the toddler. The apparatus 10 then allows the user to create a personalized boundary to suit the needs of the person.

Figure 2:
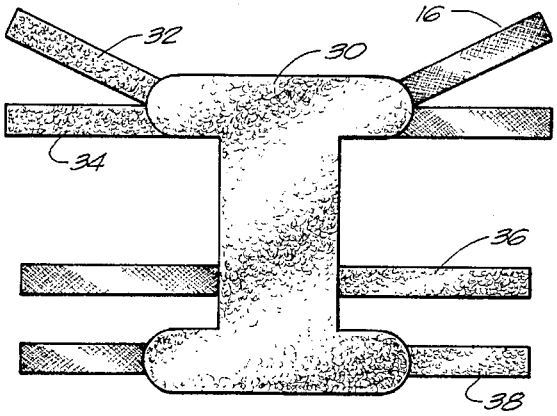
FIG. 2 is an isolated rear view of the restraining member of the present invention.

FIG. 2 is an inside view of the securing member 16. As can be seen, the securing member 16 has an I-shaped member 30 having a surface of loop material thereon. The loop material is chosen for the inside surface of the I-shaped member since the loop material is relatively comfortable. In contrast, hook material would be somewhat uncomfortable and abrasive to the knees and/or feet of the toddler.

In the view of FIG. 2, a first loop material strap 32 and a second loop material strap 34 extend outwardly from one side of the top of the I-shaped member. A third loop material strap 36 extends outwardly from a mid-area of the I-shaped member 30. A fourth loop material strap 38 extends outwardly from an opposite side of a bottom of the I-shaped member 30.

Figure 3:
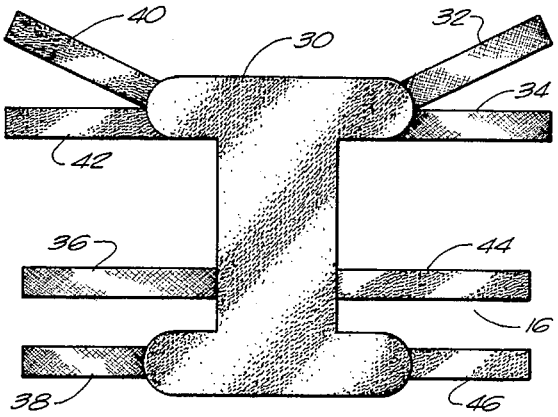
FIG. 3 is an outer view of the restraining member of the present invention.

FIG. 3 shows an outer view of the securing member 16 in accordance with the preferred embodiment of the present invention. It can be seen that the outer surface of the I-shaped member 30 is of a hook material. This hook material is suitable for engaging the loop material along the outer edge 20 of the perimeter member 14. Generally, the hook material will cover the outer surface of the I-shaped member 30. Additionally, it can be seen that a first hook material strap 40 and a second hook material strap 42 extend outwardly from an opposite side of the top of the I-shaped member 30. A third hook material strap 44 extends outwardly from one side of the I-shaped member 30 opposite to the loop material strap 36. A fourth hook material strap 46 extends outwardly from one side of the bottom of the I-shaped member 30 opposite to the loop material strap 38. As used herein, the illustrations of the loop material straps 32, 34, 36, and 38 of FIG. 2 show the loop material as facing the view of FIG. 2. Similarly, the hook material straps 40, 42, 44 and 46 of FIG. 3 are illustrated as facing the view of FIG. 3.

Figure 9:
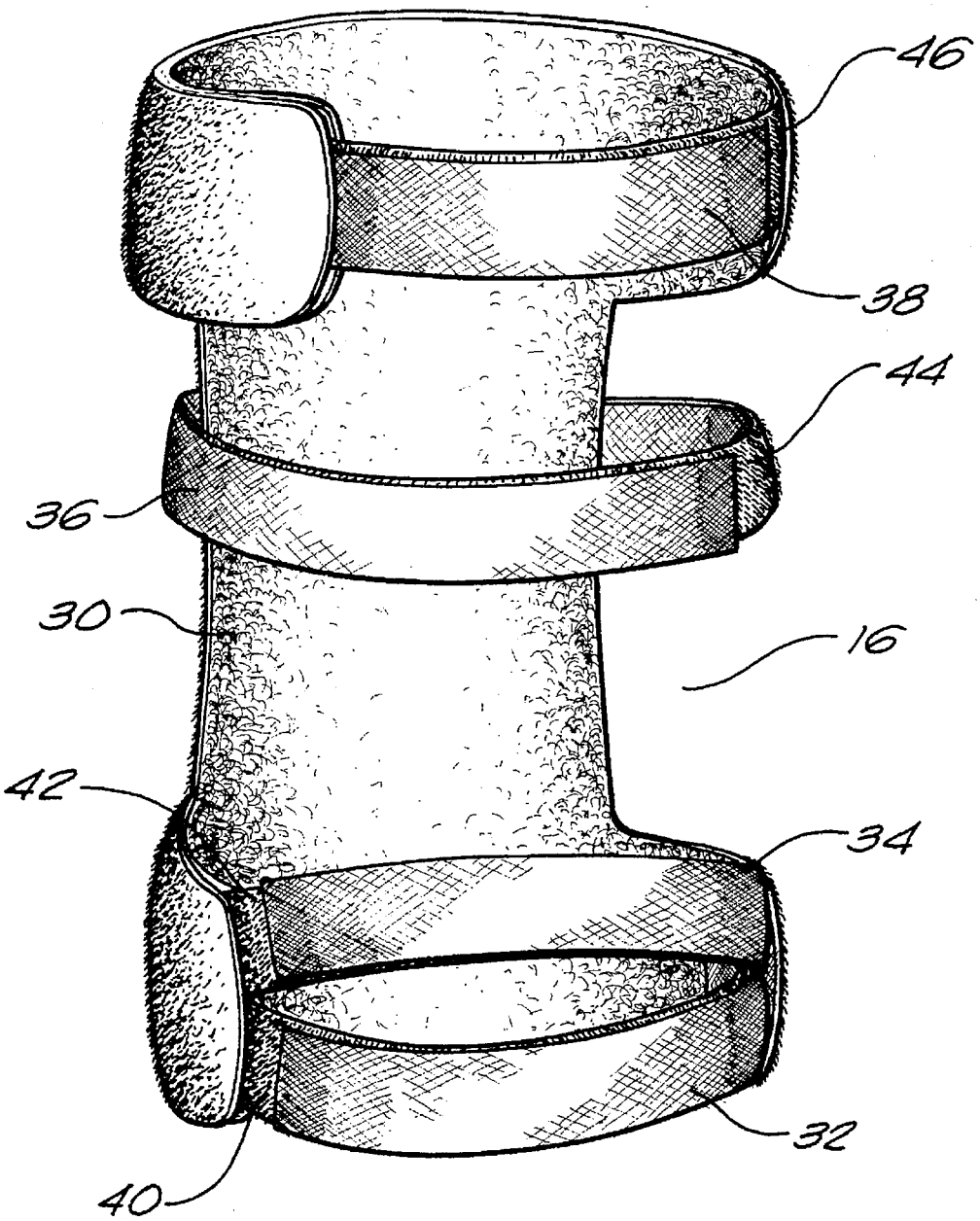
FIG. 9 is a perspective view of the kneepad formed from the restraining member of the present invention.

In order to secure the securing member 16 to the knee of a toddler, it is only necessary to position the I-shaped member 30 such that the hook material is opposite the knee of the toddler. As can be seen in FIG. 9, the first loop material strap 32 can then be wrapped around the leg of the toddler so as to engage the first loop material strap 40. The second loop material strap 34 will also wrap around a leg of the toddler so as to engage the second hook material strap 42. The third hook material strap 44 will also wrap around the leg of the toddler so as to engage the third loop material strap 36. Finally, the fourth hook material strap 46 will wrap around the leg of the toddler so as to engage the fourth loop material strap 38. The comfortable loop material on the inside of the securing member 16 will be resting against the knee of the toddler. In this arrangement, the securing member 16 can be configured so as to fit around the knees of the toddler in the manner shown in FIG. 1. Each of the straps should have a sufficient peel strength so as to prevent removal by the toddler.

Figure 4:
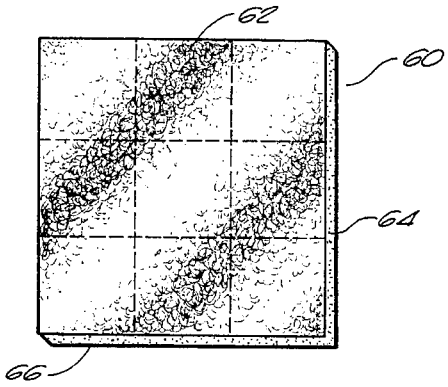
FIG. 4 is a plan view of the perimeter member of one embodiment of the present invention.

FIG. 4 shows one embodiment of the perimeter member 60 in accordance with the present invention. It can be seen in FIG. 4 that the top surface 62 of the perimeter member 60 is entirely covered with the loop material. A cushion layer 64 is interposed between a bottom surface 66 and the top surface 62. By covering the top surface 62 with the loop material, the perimeter member 60 is designed so as to restrain the movement of the toddler to a small area. The cushion material 64 can be foam, or similar material, so as to cushion the toddler while the toddler is placed upon the perimeter member 60. The loop material in combination with the hook material of the restraining members should have a sufficient peel strength so as to prevent the toddler from releasing from the loop material (without adult assistance).

Figure 5:
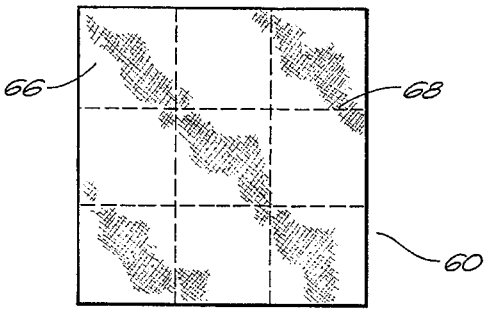
FIG. 5 is a bottom view of the perimeter member of FIG. 4.

FIG. 5 shows the bottom surface 66. The bottom surface 66 should be of a material other than hook-and-loop material. Typically, the bottom surface 66 will be of a vinyl material. The bottom surface 66 is secured to the cushion material 64 and to the top surface 60 through the use of stitching 68. By the use of stitching, the perimeter member 60 is suitable for folding and for easy storage and containment.

Figure 6:
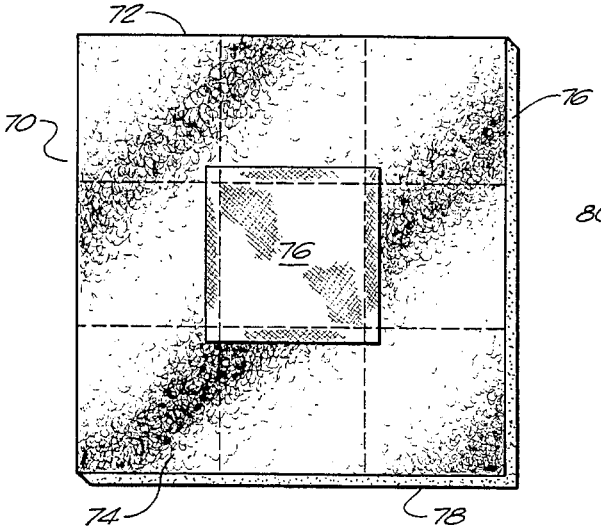
FIG. 6 is a plan view of an alternative embodiment of the perimeter member of the present invention.

FIG. 6 shows an embodiment of the perimeter member 70 in a form similar to that shown in FIG. 1. It can be seen that the outer edge 72 on the top surface 74 has loop material extending therearound. Typically, the loop material forming the outer edge 72 will have a width of greater than one foot. The central area 76 can be of a vinyl material which has its outer edges secured to the inner edges of the loop material. The interior area 76 is suitable for allowing the toddler freedom of movement before encountering the restraining loop material of the outer edge 72. A cushion material 76 is positioned below the top surface 74 so as to provide comfort and safety for the toddler which is placed upon the perimeter member 70. A bottom surface 78 resides below the cushion material 76 and below the top surface 74.

Figure 7:
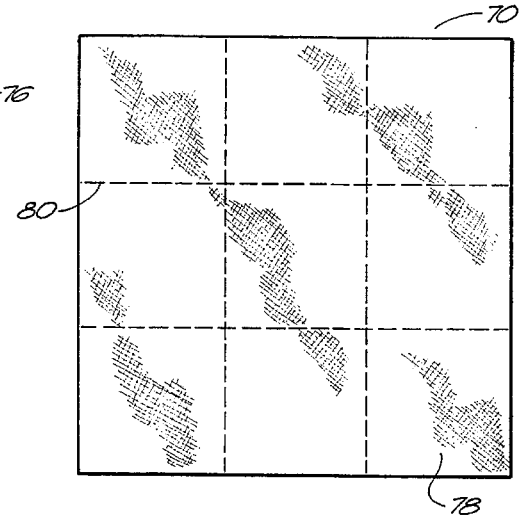
FIG. 7 is a bottom view of the perimeter member of FIG. 6.

FIG. 7 shows the bottom surface 78. The bottom surface 78 will be of a material other than hook-and-loop material, such as vinyl. The bottom surface 78 is secured to the cushion material 76 and to the top surface 74 through the use of stitching 80. The stitching 80 further facilitates the ability of the perimeter member 70 to be easily folded and stored. The configuration of the present invention, in the form shown in either FIGS. 4 and 5 or in FIGS. 6 and 7, presents an attractive restraining apparatus.

Figure 8:
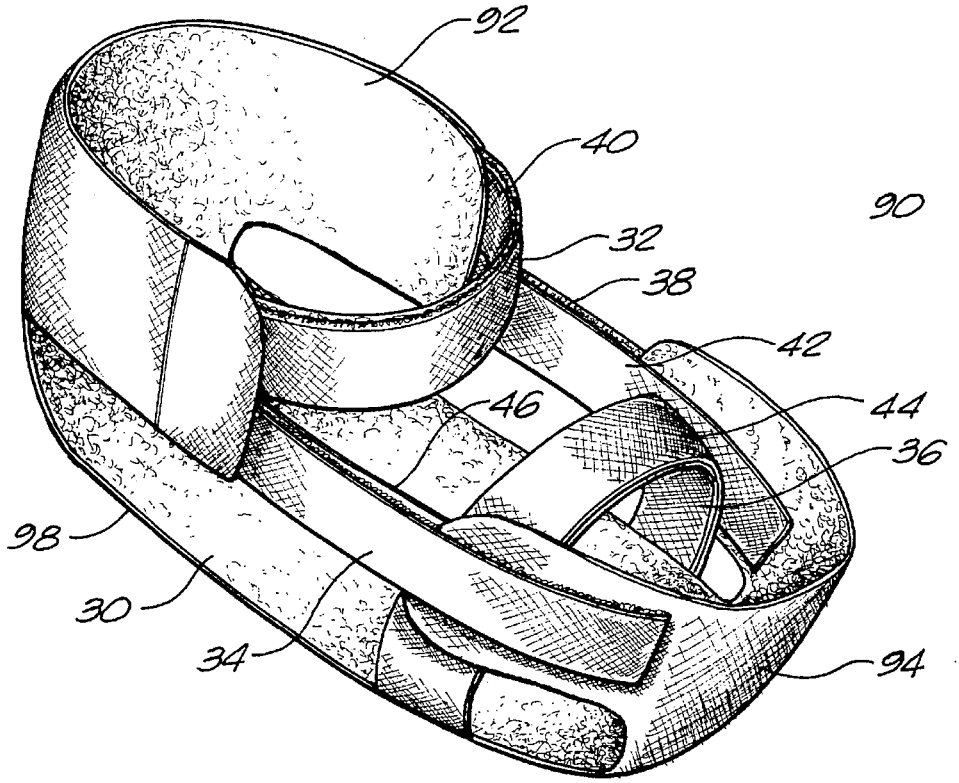
FIG. 8 is a perspective view of the sandal formed from the restraining member of the present invention.

In those circumstances in which the toddler is of a walking age, then the securing member 16 can be configured in the form of sandal 90. FIG. 8 shows the configuration of the sandal 90 using the I-shaped member 30, and associated straps, of FIGS. 2 and 3.

Initially, it can be seen that the I-shaped member 30 has its top 92 folded upwardly so as to generally surround the ankle of the toddler. The interior surface of the I-shaped member 30 is of the comfortable loop material. So as to properly secure the top 92 of the I-shaped member 30 around the ankle of the toddler, the first loop material strap 32 is engaged to the first hook material strap 40. The second loop material strap 34 will extend outwardly and engage the outer hook material surface of the bottom 94 of the I-shaped member 30. This loop material strap 34 will form the side of the sandal 90. Similarly, the fourth hook material strap 46 will extend in the opposite direction so as to engage the loop material on the inside surface of the top of the I-shaped member 40. The second hook material strap 42 will extend from the top 92 of the I-shaped member 30 so as to engage the inner loop material at the bottom 94. The fourth loop material strap 38 will extend upwardly from the bottom 94 and engage the outer surface of the top 92. As can be seen, the straps 34, 38, 42, and 46 form the sides of the sandal 90. The third loop material strap 36 will extend upwardly and engage the inner surface of the third hook material strap 44 so as to extend, in a loop, around the foot of the toddler.

The bottom surface 98 of the sandal 90 will be of the hook material. As the toddler moves outside of the open area of the perimeter member 14, the hook material on the bottom surface 98 of the sandal 90 will engage the loop material at the outer edges of the perimeter member 14 so as to restrict and restrain further movement. The hook material of the sandal 90 and the loop material of the perimeter member should have sufficient peel strength so as to prevent the toddler from independently separating the sandal 90 from the loop material of the perimeter member.

It is unique to the present invention that the same configuration that is used to form the kneepad (as shown in FIG. 1) can also be used so as to form a sandal for wearing by a walking toddler. As such, the present invention eliminates the need for additional components and pieces. As the toddler ages, the ability to adapt to the walking condition will extend useful life of the apparatus 10.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus for restraining movement of a toddler comprising:

a securing means for affixing to the toddler, said securing means having a surface of hook-and-loop material thereon; and a perimeter member having a complementary hook-and-loop material surface formed thereon, said complementary hook-and-loop material surface engagable with said surface of said securing means so as to restrain movement of the toddler thereacross, said perimeter member having a top surface entirely covered with said complementary hook-and-loop material.

2. The apparatus of claim 1, said complementary hook-and-loop material surface of said perimeter member being of loop material.

3. The apparatus of claim 2, said perimeter member having a bottom surface of a material other than a hook-and-loop material, said perimeter member having a cushion material interposed between said top surface and said bottom surface.

4. The apparatus of claim 1, said perimeter member further comprising:

a bottom surface of a material other than complementary hook-and-loop material; and a cushion layer interposed between said complementary hook-and-loop material and said bottom surface.

5. The apparatus of claim 1, said securing means being a kneepad having an outer surface of hook material facing outwardly therefrom.

6. The apparatus of claim 1, said securing means comprising:

an I-shaped member having said surface of hook-and-loop material on one side; and a plurality of straps extending outwardly from said I-shaped member, said plurality of straps for securing said I-shaped member to the toddler.

7. The apparatus of claim 6, said plurality of straps further comprising:

first and second loop material straps extending outwardly from one side of a top of said I-shaped member; and first and second hook material straps extending outwardly from an opposite side of said top of said I-shaped member.

8. The apparatus of claim 7, said plurality of straps further comprising:

a third hook material strap extending outwardly from said one side of a middle area of said I-shaped member; and a third loop material strap extending outwardly from said opposite side of said middle area of said I-shaped member.

9. The apparatus of claim 8, said plurality of straps further comprising:

a fourth hook material strap extending outwardly from one side of a bottom of said I-shaped member; and a fourth loop material strap extending outwardly from said opposite side of said bottom of said I-shaped member.

10. The apparatus of claim 9, said securing means being a kneepad, said first and second loop material straps engaging said first and second hook material straps around a leg of the toddler, said third hook material strap engaging said third loop material strap around the leg of the toddler, and said fourth hook material strap engaging said fourth loop material strap around the leg of the toddler.

11. The apparatus of claim 10, said surface of hook-and-loop material being hook material facing outwardly of the leg of the toddler.

12. The apparatus of claim 9, said I-shaped member having a surface of hook material on one side and a surface of loop material on an opposite side.

13. The apparatus of claim 12, said securing means being a sandal, said first loop material strap engaging said first hook material strap, said second loop material strap engaging said surface of said hook material at said bottom of said I-shaped member, said second hook material strap engaging said surface of loop material at said bottom of said I-shaped member, said third hook material strap engaging said third loop material strap, said fourth hook material strap engaging said surface of loop material at said top of said I-shaped member, said fourth loop material strap engaging said surface of hook material at said top of said I-shaped member.

14. The apparatus of claim 13, said middle area of said I-shaped member receiving a sole of a foot of the toddler, said top of said I-shaped member and said first and second loop material straps and said first and second hook material straps extending around an ankle of the toddler.

15. An apparatus for restraining movement of a toddler comprising:

a securing means for affixing to the toddler, said securing means having a surface of hook-and-loop material thereon; and a perimeter member having a complementary hook-and-loop material surface formed thereon, said complementary hook-and-loop material surface engagable with said surface of said securing means so as to restrain movement of the toddler thereacross, said perimeter member having an outer edge of said complementary hook-and-loop material extending entirely therearound, said perimeter member having an interior devoid of said complementary hook-and-loop material.

16. The apparatus of claim 15, said interior being of a vinyl material, said vinyl material being secured to said complementary hook-and-loop material.

17. The apparatus of claim 15, said complementary hook-and-loop material being of a loop material.

18. The apparatus of claim 15, said outer edge of said complementary hook-and-loop material having a width of greater than one foot.

19. An apparatus for restraining movement of a toddler comprising:

a securing means for affixing to the toddler, said securing means having a surface of hook-and-loop material thereon; and a perimeter member having a complementary hook-and-loop material surface formed thereon, said complementary hook-and-loop material surface engagable with said surface of said securing means so as to restrain movement of the toddler thereacross, said securing means being a sandal having a sole of hook material facing outwardly therefrom.

* * * * *